US007081149B2

(12) United States Patent
Hirasawa et al.

(10) Patent No.: US 7,081,149 B2
(45) Date of Patent: Jul. 25, 2006

(54) SILVER POWDER FOR SILVER CLAY AND SILVER CLAY CONTAINING THIS SILVER POWDER

(75) Inventors: Juichi Hirasawa, Sanda (JP); Yasuo Ido, Sanda (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 10/490,972

(22) PCT Filed: Jun. 18, 2002

(86) PCT No.: PCT/JP02/06064

§ 371 (c)(1),
(2), (4) Date: Aug. 6, 2004

(87) PCT Pub. No.: WO03/028927

PCT Pub. Date: Apr. 10, 2003

(65) Prior Publication Data

US 2005/0115466 A1 Jun. 2, 2005

(30) Foreign Application Priority Data

Sep. 28, 2001 (JP) ..... 2001-301375

(51) Int. Cl.
*B22F 1/00* (2006.01)

(52) U.S. Cl. ..... 75/252

(58) Field of Classification Search ..... 75/252, 75/255

See application file for complete search history.

(56) References Cited

U.S. PATENT DOCUMENTS

| | | | | |
|---|---|---|---|---|
| 3,502,466 | A * | 3/1970 | Vickery | 419/27 |
| 4,689,197 | A * | 8/1987 | Groll et al. | 419/23 |
| 4,970,050 | A * | 11/1990 | Groll et al. | 419/36 |
| 5,376,328 | A * | 12/1994 | Hoshino et al. | 419/36 |
| 5,702,501 | A * | 12/1997 | Osawa et al. | 75/255 |
| 5,943,544 | A * | 8/1999 | Morita et al. | 419/5 |
| 6,290,744 | B1 * | 9/2001 | Fujimaru et al. | 75/247 |
| 6,383,248 | B1 * | 5/2002 | Taylor et al. | 75/247 |

FOREIGN PATENT DOCUMENTS

| | | | |
|---|---|---|---|
| EP | 0457350 | A1 | 11/1991 |
| JP | 04-026707 | A1 | 1/1992 |
| JP | 04-147902 | A1 | 5/1992 |
| JP | 04-190682 | * | 7/1992 |
| JP | 04-303909 | * | 10/1992 |
| JP | 06-158102 | A1 | 6/1994 |
| JP | 07-070602 | A1 | 3/1995 |

OTHER PUBLICATIONS

Patent Abstracts of Japan for JP07-070602 published on Mar. 14, 1995.
Patent Abstracts of Japan for JP06-158102 published on Jun. 7, 1994.
Patent Abstracts of Japan for JP04-147902 published on May 21, 1992.
Patent Abstracts of Japan for JP04-026707 published on Jan. 29, 1992.

* cited by examiner

*Primary Examiner*—Ngoclan T. Mai
(74) *Attorney, Agent, or Firm*—Darby & Darby

(57) ABSTRACT

A silver clay that can be obtained by sintering at a low temperature. A silver powder for silver clay is a fine Ag powder having an approximate average particle diameter equal to or less than 2 μm incorporated at 15 to 50 weight %, with the remainder being an Ag powder having an average particle diameter that exceeds approximately 2 μm and is equal to or less than approximately 100 μm. The silver clay includes this silver powder incorporated at approximately 50 to 95 weight %, a binder at approximately 0.0 to 8 weight %, an oil at approximately 0.1 to 3 weight %, and a surface active agent at approximately 0.03 to 3 weight %, with the remainder being water.

9 Claims, 2 Drawing Sheets

SILVER POWDER FOR SILVER CLAY AND SILVER CLAY CONTAINING THIS SILVER POWDER

CROSS-REFERENCE TO PRIOR APPLICATION

This is a U.S. national phase application under 35 U.S.C. §371 of International Patent Application No. PCT/JP02/06064 filed Jun. 18, 2002, and claims the benefit of Japanese Patent Application No. 2001-301375 filed Sep. 28, 2001 which is incorporated by reference herein. The International Application was published in Japanese on Oct. 4, 2003 as WO 03/028927 A1 under PCT Article 21(2).

BACKGROUND OF THE INVENTION

1. Field of the Invention

The present invention relates to a silver powder for a silver clay having superior sintering characteristics at low temperatures and a silver clay that contains this silver powder.

2. Description of Related Art

Generally, silver ornaments and artworks are manufactured by using casting or forging. However, in recent years, a clay that contains silver powder (Ag powder) has become commercially available, and a method has been proposed wherein the silver ornaments or artworks having a predetermined shape are manufactured by molding this silver clay into a predetermined shape, and sintering it. According to this method, by using the silver clay, it is possible to carry out free molding in a manner identical to that of normal clay craftwork. After the molded article obtained by molding is dried, it is sintered in a sintering furnace, and thereby it is possible to manufacture silver ornaments and artworks extremely easily.

A conventional silver clay is known that consists of a silver powder having a high purity of 99.99 weight % and an average particle diameter of 3 to 20 μm incorporated at 50 to 95 weight %, a cellulose water soluble binder at 0.8 to 8 weight %; an oil at 0.1 to 3 weight %, a surface active agent at 0.03 to 3 weight %; with the remainder being water (refer to Japanese Unexamined Patent Application, First Publication No. Hei 4-26707).

When the conventional silver clay is used, a sintered article that has sufficient strength cannot be obtained unless the temperature is maintained at or above the melting point of silver while being sintered in an electrical furnace after the molded article made of the silver clay has dried. It is possible to obtain a sufficiently strong sintered article if the electrical furnace used to sinter the silver clay has a capacity that can maintain a sufficiently high temperature inside the furnace. However, because individually owned electrical furnaces frequently are small scale and have a low heat capacity, it is not possible to maintain the temperature in the furnace at or above the melting point of silver, and as a result, a sintered article having sufficient density cannot be obtained.

In addition, even if the electrical furnace can maintain a sufficiently high temperature, frequently it is not possible to control the temperature inside the furnace accurately, and as a result, when the temperature in the furnace becomes too high, the shape of the sintered article becomes distorted.

SUMMARY OF THE INVENTION

Thus, the inventors carried out investigations to ascertain that if the silver clay can be sintered at a comparatively low temperature, then it would be possible to carry out sintering satisfactorily even using a household electrical furnace having a low heat capacity, and furthermore, if temperature control of the electrical furnace is comparatively simple at low temperatures and the silver clay can be sintered at a low temperature, then satisfactory sintering would be possible even if accurate temperature control cannot be carried out.

As a result, it was discovered that a silver clay in which an organic binder or other additives are added to a silver powder for a silver clay can used to carry out satisfactory sintering even when the sintering is 250 to 410° C. below the melting point of pure silver (that is, a temperature of 550 to less than 710° C.), where the silver powder for the silver clay is prepared by mixing such that a fine Ag powder having an average particle diameter of 2 μm (preferably a fine Ag powder having an average particle diameter of 0.5 to 1.5 μm) is incorporated at approximately 15 to 50 weight %, and a Ag powder having an average particle diameter exceeding 2 μm and equal to or less than 100 μm (preferably a fine Ag powder having an average particle diameter of 3 to 20 μm) is incorporated at approximately greater than 50 weight % and less than 85 weight %.

Based on such knowledge, this invention provides:

(1) a silver powder for a silver clay formed using a mixed powder of a fine Ag powder having an average particle diameter equal to less than 2 μm incorporated at approximately 15 to 50 weight %, with the remainder substantially being a Ag powder having an average particle diameter exceeding 2 μm and equal to or less than 100 μm; and (2) a silver powder for a silver clay formed using a mixed silver power of a fine Ag power having an average particle diameter of 0.5 to 1.5 μm incorporated at approximately 15 to 50 weight %, with the remainder substantially being a Ag powder having an average particle diameter between 3 and 20 μm.

In addition, the silver clay of the present invention is a silver clay produced by mixing into the silver powder for a silver clay disclosed in (1) and (2) described above: an organic binder, or an organic binder having added thereto an oil, surface active agent or the like. Specifically, the present invention provides:

(3) a silver clay containing the silver powder for silver clay disclosed in (1) and (2) described above at approximately 50 to 95 weight %, an organic binder at approximately 0.8 to 8 weight %, with the remainder being water;

(4) a silver clay containing the silver powder for silver clay disclosed in (1) and (2) described above at approximately 50 to 95 weight %, an organic binder at approximately 0.8 to 8 weight %, a surface active agent at approximately 0.03 to 3 weight %, with the remainder being water;

(5) a silver clay containing the silver powder for silver clay disclosed in (1) and (2) described above at approximately 50 to 95 weight %, an organic binder at approximately 0.8 to 8 weight %, an oil at approximately 0.1 to 3 weight %, with the remainder being water; and (6) a silver clay containing the silver powder for silver clay disclosed in (1) and (2) described above at approximately 50 to 95 weight %, an organic binder at approximately 0.8 to 8 weight %, an oil at approximately 0.1 to 3 weight %, a surface active agent at approximately 0.03 to 3 weight %, with the remainder being water.

The fine Ag powder having an average particle diameter equal to or less than 2 μm contained in the silver powder for the silver clay of the present invention is preferably a spherical fine Ag powder manufactured by using a chemical reduction method or the like. The reason for limiting the content of this fine Ag powder to approximately 15 to 50 weight % is that when the content of the fine Ag powder having an average particle diameter equal to or less than 2 μm is less than approximately 15 weight %, the physical strength of the obtained sintered article deteriorates, and is thus not preferable. When the content of the fine Ag powder having an average particle diameter equal to or less than 2 μm exceeds approximately 50 weight %, the amount of the organic binder that imparts pliability to the clay is increased, and thus the coefficient of contraction during sintering becomes large, which is not preferable. The preferable range for the content of the fine Ag powder having an average particle diameter equal to or less than 2 μm is thus approximately 20 to 45 weight %.

Furthermore, the reason that the remainder of the Ag powder contained in the silver powder for silver clay of the present invention has an average particle diameter that exceeds 2 μm and is equal to or less than 100 μm is that when the average particle diameter is equal to or less than 2 μm, the physical strength of the sintered article deteriorates, and when the average particle diameter exceeds 100 μm, the molding characteristics of the clay deteriorate.

In order to make the particle distribution of the silver particles for silver clay of the present invention easier to understand, the particle distribution curves of the silver clay particles shown in FIG. 1 will be explained. The silver powder for the silver clay of the present invention is composed of a mixed silver powder obtained by mixing a fine Ag powder having an average particle diameter equal to or less than 2 μm (preferably, an average particle diameter of 0.5 to 1.5 μm, and more preferably, 0.6 to 1.2 μm) and an Ag powder having an average particle diameter greater than 2 μm and equal to or less than 100 μm (preferably, an average particle diameter of 3 to 20 μm, and more preferably, 3 to 8 μm). Therefore, as shown by the solid line in FIG. 1, the particle distribution curve 1 of the silver powder for the silver clay of the present invention exhibits at least one peak A for the fine Ag powder having an average particle diameter equal to or less than 2 μm (preferably, an average particle diameter or 0.1 to 0.5 μm, and more preferably 0.6 to 1.2 μm), and exhibits at least one peak B for the silver powder having an average particle diameter larger than 2 μm and equal to or less than 100 μm (preferably, an average particle diameter of 3 to 20 μm, and more preferably, 3 to 8 μm). That is, the particles of the silver powder for the silver clay of the present invention exhibit a particle distribution curve 1 having at least two peaks A and B. In contrast, because the average particle diameter of a conventional silver powder for silver clay is 3 to 20 μm, the particle distribution thereof exhibits the particle distribution curve 2, which has one peak X, as shown by the dashed line in FIG. 1. Therefore, the particle distribution of the silver powder for the silver clay of this invention differs from that of the conventional silver powder for silver clay.

Note that the average particle diameter of the fine Ag powder and the Ag powder that constitute the silver powder for silver clay of the present invention is an average particle diameter of a fine Ag powder and an Ag powder that does not include clumps of powder.

In addition, the reason that the content of the silver powder for silver clay in (1) and (2) described above, which are contained in the silver clay of the present invention, is limited to approximately 50 to 95 weight % is that when the content of the silver powder for silver clay is less than approximately 50 weight %, the effect of satisfactorily exhibiting the metallic luster of the obtained sintered article is insufficient, and when it exceeds approximately 95 weight %, the pliability and strength of the clay deteriorate, neither of which is preferable. A more preferable range of the content of the silver powder for silver clay is thus approximately 70 to 95 weight %.

The organic binders that are contained in the silver clay of the present invention include cellulose binders, polyvinyl binders, acryl binders, wax binders, resin binders, starch, gelatin, wheat flour, and the like. However, a cellulose binder, in particular, a water soluble cellulose binder, is most preferable. These binders quickly gel when heated, and facilitate the maintaining of the shape of the molded body. When the added amount of the organic binder is less than approximately 0.8 weight %, there is no effect, and when the amount exceeds approximately 8 weight %, fine cracks occur in the obtained molded article and the luster decreases, neither of which is preferable. The content of the binder in the silver clay of the present invention is thus approximately 0.8 to 8 weight %, and more preferably, the range is approximately 0.8 to 5 weight %.

Depending on necessity, surface active agents can be added, and when added, the added amount is preferably about 0.03 to 3 weight %. In addition, the types of the added surface active agents are not particularly limited, and common surface active agents can be used.

Depending on necessity, oils can also be added, and when added, the added amount is preferably about 0.1 to 3 weight %. Added oils include organic acids (oleic acid, stearic acid, phthalic acid, palmitic acid, sebacic acid, acetylcitric acid, hydroxybenzoic acid, lauric acid, myristic acid, caproic acid, enanthic acid, butyric acid, capric acid), organic esters (organic esters containing a methyl group, ethyl group, propyl group, butyl group, oxyl group, hexyl group, dimethyl group, diethyl group, isopropyl group, isobutyl group), higher alcohols (octanol, nonanol, decanol), polyalcohols (glycerin, arabitol, sorbitol), ethers (dioxyl ether, didecyl ether), and the like.

DETAILED DESCRIPTION OF THE INVENTION

Embodiment 1

Nine types of silver powder for silver clay having different particle distributions were produced by a spherical fine Ag powder having an average particle diameter of 1.0 μm produced by a chemical reduction method being mixed into an atomized Ag powder having an average particle diameter of 5.0 μm, at 0 weight %, 10 weight %, 20 weight %, 30 weight %, 40 weight %, 50 weight %, 60 weight %, 80 weight %, and 100 weight %. Furthermore, methyl cellulose, a surface active agent, olive oil as an oil, and water were added to the nine types of silver powder for silver clay having differing particle distributions, and silver clays 1 to 9 were produced that contain the silver powder for silver clay at 85 weight %, methyl cellulose at 4.5 weight %, surface active agent at 1.0 weight %, olive oil at 0.3 weight %, with the remainder being water.

Figure 1:
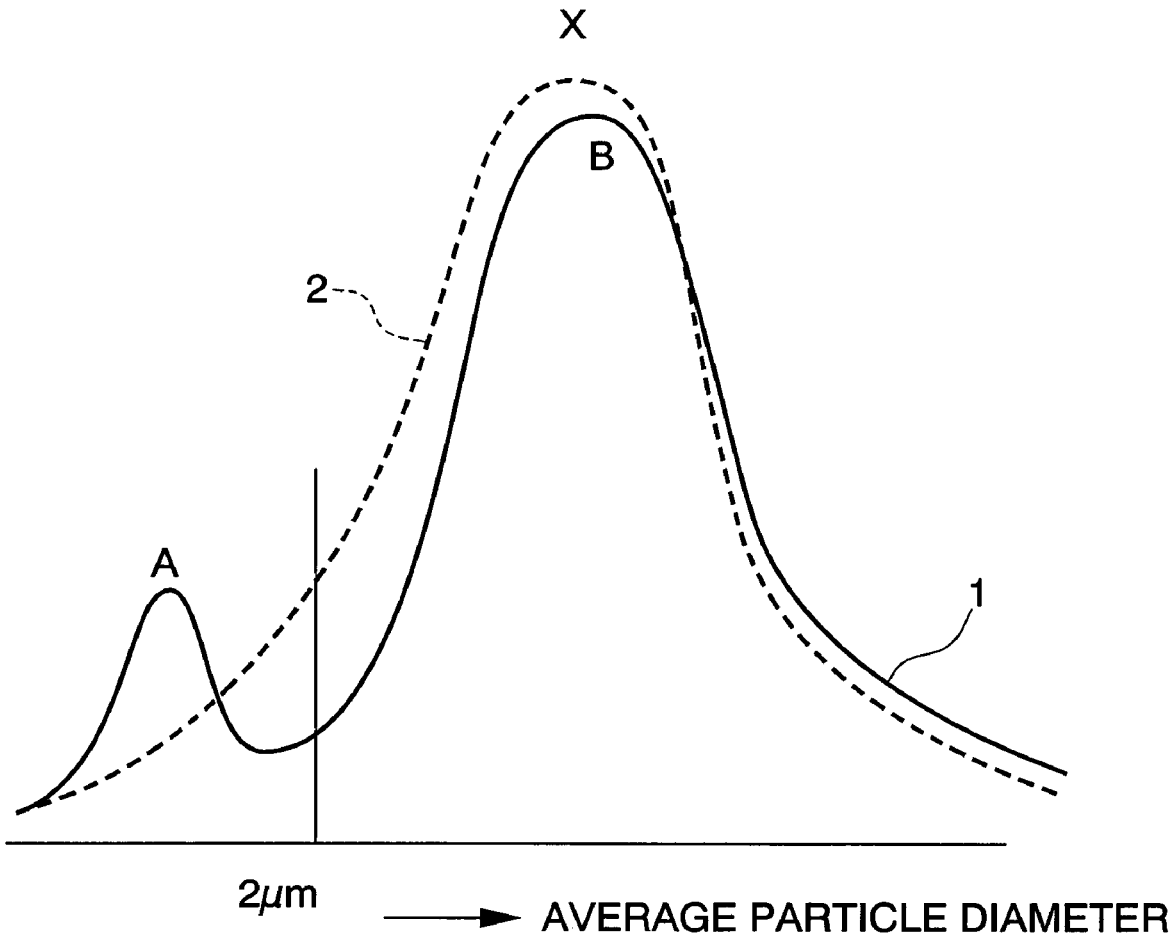
FIG. 1 is a drawing showing the grain distribution curve of the silver clay powder for explaining the difference between the silver powder for silver clay of the present invention and the conventional silver powder for silver clay.
Figure 2:
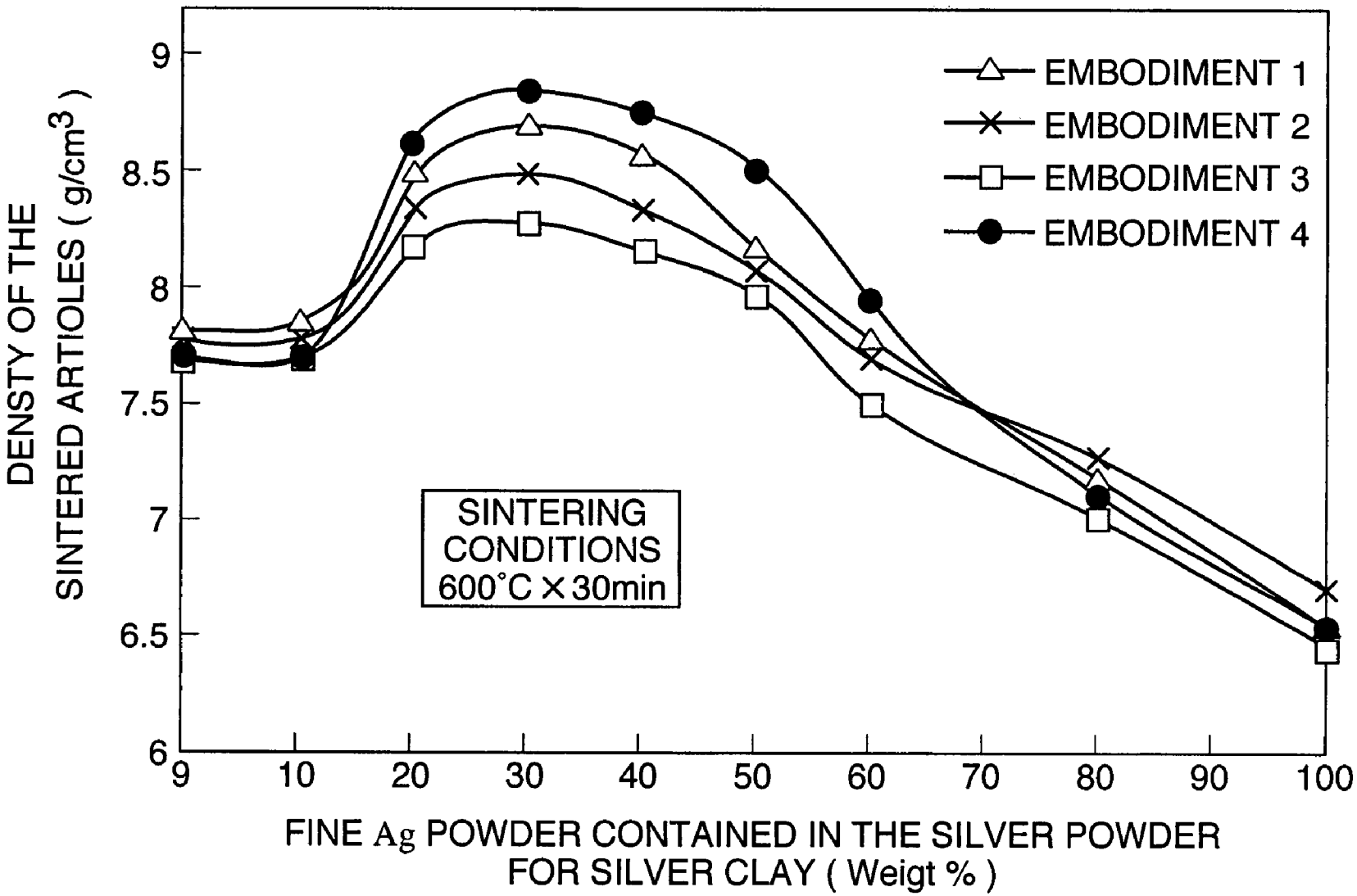
FIG. 2 is a graph showing the relationship between the content of the fine Ag powder included in the clay having an average particle diameter equal to or less than 2 μm.

The silver clays 1 to 9 were molded, and the obtained molded articles were sintered 30 minutes at a low temperature of 600° C. to produce sample sintered articles having dimensions of a length of 3 mm, a width of 4 mm, and a thickness of 65 mm. The tensile strength and the density of the obtained sample sintered articles were measured, and the results of the measurements are shown in Table 1. Furthermore, the graph shown in FIG. 2 was produced by plotting the Δ marks and connecting these Δ marks with a line, where, as shown in Table 2, the measured values of the density are on the ordinate and the content of the spherical fine Ag powder included in the silver powder for silver clay are on the abscissa.

TABLE 1

| | | Silver powder for silver clay | | Sample sintered articles | |
|---|---|---|---|---|---|
| | | Spherical fine Ag powder, | Atomized Ag powder, | | |
| Type | | average particle diameter = 1 μm | average particle diameter = 5 μm | Tensile strength (N/mm$^2$) | Density (g/cm$^3$) |
| Silver clay | 1 | *— | 100 | 43 | 7.8 |
| | 2 | *10 | remainder | 45 | 7.9 |
| | 3 | 20 | remainder | 80 | 8.5 |
| | 4 | 30 | remainder | 100 | 8.7 |
| | 5 | 40 | remainder | 75 | 8.6 |
| | 6 | 50 | remainder | 73 | 8.2 |
| | 7 | *60 | remainder | 51 | 7.8 |
| | 8 | *80 | remainder | 42 | 7.2 |
| | 9 | *100 | — | 38 | 6.5 |

(The * mark denotes a value falling outside of the range of this invention.)

Embodiment 2

Nine types of silver powder for silver clay were having different particle distributions were produced by a spherical fine Ag powder having an average particle diameter of 1.5 μm produced by a chemical reduction method being mixed into an atomized Ag powder having an average particle diameter of 5.0 μm, at 0 weight %, 10 weight %, 20 weight %, 30 weight %, 40 weight %, 50 weight %, 60 weight %, 80 weight %, and 100 weight %. Using these nine types of silver powder for silver clay having different particle distributions, silver clays 10 to 18 were produced by the same method as Embodiment 1.

These silver clays 10 to 18 were molded, and sample sintered articles were produced by sintering the obtained molded articles under conditions identical to those of Embodiment 1. The tensile strength and the density of the obtained sample sintered articles were measured in a manner identical to that in Embodiment 1, and the results of the measurements are shown in Table 2. Furthermore, the graph shown in FIG. 2 was produced plotting the x marks and connecting the x marks with a line, where, as shown in Table 2, the measured values of the density are on the ordinate and the content of the spherical fine Ag powder included in the silver powder for silver clay are on the abscissa.

TABLE 2

| | | Silver powder for silver clay | | Sample sintered articles | |
|---|---|---|---|---|---|
| | | Spherical fine Ag powder, | Atomized Ag powder, | | |
| Type | | average particle diameter = 1.5 μm | average particle diameter = 5 μm | Tensile strength (N/mm$^2$) | Density (g/cm$^3$) |
| Silver clay | 10 | *— | 100 | 38 | 7.8 |
| | 11 | *10 | remainder | 51 | 7.7 |
| | 12 | 20 | remainder | 90 | 8.4 |
| | 13 | 30 | remainder | 95 | 8.5 |
| | 14 | 40 | remainder | 73 | 8.3 |
| | 15 | 50 | remainder | 70 | 8.1 |
| | 16 | *60 | remainder | 50 | 7.7 |
| | 17 | *80 | remainder | 43 | 7.3 |
| | 18 | *100 | — | 40 | 6.7 |

(The * mark denotes a value falling outside of the range of this invention.)

Embodiment 3

Nine types of silver powder for silver clay were having different particle distributions were produced by a spherical fine Ag powder having an average particle diameter of 0.5 μm produced by a chemical reduction method being mixed into an atomized Ag powder having an average particle diameter of 5.0 μm, at 0 weight %, 10 weight %, 20 weight %, 30 weight %, 40 weight %, 50 weight %, 60 weight %, 80 weight %, and 100 weight %. Using these nine types of silver powder for silver clay having different particle distributions, silver clays 19 to 27 were produced by the same method as Embodiment 1.

These silver clays 19 to 27 were molded, and sample sintered articles were produced by sintering the obtained molded articles under conditions identical to those of Embodiment 1. The tensile strength and the density of the obtained sample sintered article were measured in a manner identical to that in Embodiment 1, and the results of the measurements are shown in Table 3. Furthermore, the graph shown in FIG. 2 was produced by plotting the □ marks and connecting the □ marks with a line, where, as shown in Table 3, the measured values of the density are on the ordinate and the content of the spherical fine Ag powder included in the silver powder for silver clay are on the abscissa.

TABLE 3

| | | Silver powder for silver clay | | Sample sintered articles | |
|---|---|---|---|---|---|
| | | Spherical fine Ag powder, | Atomized Ag powder, | | |
| Type | | average particle diameter = 0.5 μm | average particle diameter = 5 μm | Tensile strength (N/mm$^2$) | Density (g/cm$^3$) |
| Silver clay | 19 | *— | 100 | 39 | 7.7 |
| | 20 | *10 | remainder | 48 | 7.8 |
| | 21 | 20 | remainder | 92 | 8.3 |
| | 22 | 30 | remainder | 90 | 8.2 |
| | 23 | 40 | remainder | 75 | 8.1 |
| | 24 | 50 | remainder | 71 | 8.0 |
| | 25 | *60 | remainder | 51 | 7.4 |
| | 26 | *80 | remainder | 45 | 7.0 |
| | 27 | *100 | — | 35 | 6.5 |

(The * mark denotes a value falling outside of the range of this invention.)

Embodiment 4

Nine types of silver powder for silver clay were having different particle distributions were produced by a spherical fine Ag powder having an average particle diameter of 0.8 82 m produced by a chemical reduction method being mixed into an atomized Ag powder having an average particle diameter of 5.0 μm, at 0 weight %, 10 weight %, 20 weight %, 30 weight %, 40 weight %, 50 weight %, 60 weight %, 80 weight %, and 100 weight %. Using these nine types of silver powder for silver clay having different particle distributions, silver clays 28 to 36 were produced by the same method as Embodiment 1.

These silver clays 28 to 36 were molded, and sample sintered articles were produced by sintering the obtained molded articles under conditions identical to those of Embodiment 1. The tensile strength and the density of the obtained sample sintered articles were measured in a manner identical to that in Embodiment 1, and the results of the measurements are shown in Table 4. Furthermore, the graph shown in FIG. 2 was produced by plotting the ● marks and connecting the ● marks with a line, where, as shown in Table 4, the measured values of the density are on the ordinate and the content of the spherical fine Ag powder included in the silver powder for silver clay are on the abscissa.

TABLE 4

| | | Silver powder for silver clay | | Sample sintered articles | |
|---|---|---|---|---|---|
| Type | | Spherical fine Ag powder, average particle diameter = 0.8 μm | Atomized Ag powder, average particle diameter = 5 μm | Tensile strength ($N/mm^2$) | Density ($g/cm^3$) |
| Silver clay | 28 | *— | 100 | 40 | 7.7 |
| | 29 | *10 | remainder | 47 | 7.8 |
| | 30 | 20 | remainder | 85 | 8.6 |
| | 31 | 30 | remainder | 93 | 8.8 |
| | 32 | 40 | remainder | 78 | 8.7 |
| | 33 | 50 | remainder | 73 | 8.5 |
| | 34 | *60 | remainder | 52 | 7.8 |
| | 35 | *80 | remainder | 42 | 7.2 |
| | 36 | *100 | — | 39 | 6.5 |

(The * mark denotes a value falling outside of the range of this invention.)

As is clear from Tables 1 to 4, when mixed with the atomized Ag powder having an average particle diameter of 5.0 μm, silver clays 3 to 6, which incorporate at 15 to 50 weight % the silver powder for silver clay that has the spherical fine Ag powder having an average particle diameter of 1.0 μm, silver clays 12 to 15, which incorporate at 15 to 50 weight % the silver powder for silver clay that has the spherical fine Ag powder having an average particle diameter of 1.5 μm, silver clays 21 to 24, which incorporate at 15 to 50 weight % the silver powder for silver clay that has the spherical fine Ag powder having an average particle diameter of 0.5 μm, and silver clays 30 to 33, which incorporate at 15 to 50 weight % the silver powder for silver clay that has the spherical fine Ag powder having an average particle diameter of 0.8 μm, have sufficient tensile strength and density even if sintered articles are produced when the molded articles obtained by molding these silver clays are maintained 30 minutes at a temperature of 600° C., which is a lower temperature than normal. Therefore, it is understood that these silver clays have superior low temperature sintering characteristics.

In addition, it is understood that when the amount of the spherical fine Ag powder incorporated falls outside the 15 to 50 weight %, sufficient tensile strength and density cannot be obtained. This is made clearer by viewing the curves in the graph in FIG. 2.

Embodiment 5

A spherical fine Ag powder having an average particle diameter of 1.0 μm is mixed into an atomized Ag powder having an average particle diameter of 5.0 μm to produce a silver powder for silver clay. Methyl cellulose, surface active agent, olive oil, and water are mixed into the obtained silver powder for silver clay in the proportions shown in Table 5 to produce silver clays 37 to 42.

These silver clays 37 to 42 are molded, and sintered for 30 minutes at 600° C. to produce sample sintered articles having a length of 3 mm, a width of 4 mm, and a thickness of 65 mm. The tensile strength and the density of the obtained sample sintered articles were measured, and the results of the measurement are shown in Table 5.

TABLE 5

| | | Mixture composition (weight %) | | | | | Characteristics of sintered article | |
|---|---|---|---|---|---|---|---|---|
| Type | | Silver power for silver clay | Cellulose | Surface active agent | Olive oil | water | Tensile strength ($N/mm^2$) | Density ($g/cm^3$) |
| Silver clay | 37 | (silver | 7.5 | — | — | remainder | 90 | 8.2 |
| | 38 | power for | 3.0 | — | — | remainder | 93 | 8.0 |
| | 39 | silver clay | 7.5 | 2.3 | — | remainder | 100 | 8.7 |
| | 40 | of fine Ag | 4.5 | 1.0 | — | remainder | 90 | 8.2 |
| | 41 | power | 7.0 | — | 0.5 | remainder | 95 | 8.3 |
| | 42 | having an average particle diameter of 1.0 μm: 30%, and remainder atomized powder having an | 5.5 | — | 1.3 | remainder | 98 | 8.5 |

TABLE 5-continued

| | Mixture composition (weight %) | | | | | Characteristics of sintered article | |
|---|---|---|---|---|---|---|---|
| Type | Silver power for silver clay | Cellulose | Surface active agent | Olive oil | water | Tensile strength ($N/mm^2$) | Density ($g/cm^3$) |
| | average diameter of 5 μm): 80 | | | | | | |

It can be understood from the results in Table 5 that favorable low temperature sintering characteristics can be obtained even for silver clays that do not include either the surface active agent or olive oil.

As described above, the silver clay of the present invention has the superior effects that it can be sintered at a lower temperature than conventional silver clays, and thus more people can use the silver clay to produce arts and crafts and ornaments by using the silver clay.

What is claimed is:

1. A silver clay comprising:

a silver powder incorporated at about 50 to about 95 weight %;

an organic binder incorporated at about 0.8 to about 8 weight %; and water substantially being the remainder, wherein the silver powder comprises a fine Ag powder having an average particle diameter equal to or less than 2 μm and a Ag powder having an average particle diameter exceeding 2 μm and equal to or less than 100 μm, said fine Ag powder incorporated at about 15 to about 50 weight %, and said Ag powder substantially being the remainder.

2. A silver clay comprising:

a silver powder incorporated at about 50 to about 95 weight %;

an organic binder incorporated at about 0.8 to about 8 weight %; and water substantially being the remainder, wherein the silver powder comprises a fine Ag powder having an average particle diameter of 0.5 to 1.5 μm and a Ag powder having an average particle diameter of 3 to 20 μm, the fine Ag powder incorporated at about 15 to about 50 weight % and the Ag powder substantially being the remainder.

3. A silver clay comprising:

a silver powder incorporated at about 50 to about 95 weight %;

an organic binder incorporated at about 0.8 to about 8 weight %;

a surface active agent incorporated at about 0.03 to about 3 weight %; and water substantially being the remainder, wherein the silver powder comprises a fine Ag powder having an average particle diameter equal to or less than 2 μm and a Ag powder having an average particle diameter exceeding 2 μm and equal to or less than 100 μm, said fine Ag powder incorporated at about 15 to about 50 weight %, and said Ag powder substantially being the remainder.

4. A silver clay comprising:

a silver powder incorporated at about 50 to about 95 weight %;

an organic binder incorporated at about 0.8 to about 8 weight %;

a surface active agent incorporated at about 0.03 to about 3 weight %; and water substantially being the remainder, wherein the silver powder comprises a fine Ag powder having an average particle diameter of 0.5 to 1.5 μm and a Ag powder having an average particle diameter of 3 to 20 μm, the fine Ag powder incorporated at about 15 to about 50 weight % and the Ag powder substantially being the remainder.

5. A silver clay comprising:

a silver powder incorporated at about 50 to about 95 weight %;

an organic binder incorporated at about 0.8 to about 8 weight %;

an oil incorporated at about 0.1 to about 3 weight %; and water substantially being the remainder, wherein the silver powder comprises a fine Ag powder having an average particle diameter equal to or less than 2 μm and a Ag powder having an average particle diameter exceeding 2 μm and equal to or less than 100 μm, said fine Ag powder incorporated at about 15 to about 50 weight %, and said Ag powder substantially being the remainder.

6. A silver clay comprising:

a silver powder incorporated at about 50 to about 95 weight %;

an organic binder incorporated at about 0.8 to about 8 weight %;

an oil incorporated at about 0.1 to about 3 weight %; and water substantially being the remainder, wherein the silver powder comprises a fine Ag powder having an average particle diameter of 0.5 to 1.5 μm and a Ag powder having an average particle diameter of 3 to 20 μm, the fine Ag powder incorporated at about 15 to about 50 weight % and the Ag powder substantially being the remainder.

7. A silver clay comprising:

a silver powder incorporated at about 50 to about 95 weight %;

an organic binder incorporated at about 0.8 to about 8 weight %;

an oil incorporated at about 0.1 to about 3 weight %;

a surface active agent incorporated at about 0.03 to about 3 weight %; and water substantially being the remainder, wherein the silver powder comprises a fine Ag powder having an average particle diameter equal to or less than 2 μm and a Ag powder having an average particle diameter exceeding 2 μm and equal to or less than 100

μm, said fine Ag powder incorporated at about 15 to about 50 weight %, and said Ag powder substantially being the remainder.

8. A silver clay comprising:

a the silver powder incorporated at about 50 to about 95 weight %;

an organic binder incorporated at about 0.8 to about 8 weight %;

an oil incorporated at about 0.1 to about 3 weight %;

a surface active agent incorporated at about 0.03 to about 3 weight %; and water substantially being the remainder, wherein the silver powder comprises a fine Ag powder having an average particle diameter of 0.5 to 1.5 μm and a Ag powder having an average particle diameter of 3 to 20 μm, the fine Ag powder incorporated at about 15 to about 50 weight % and the Ag powder substantially being the remainder.

9. A silver clay comprising:

a silver powder incorporated at about 50 to about 95 weight %;

an organic binder; and water, wherein the silver powder comprises a fine Ag powder having an average particle diameter equal to or less than 2 μm and a Ag powder having an average particle diameter exceeding 2 μm and equal to or less than 100 μm, the fine Ag powder incorporated at about 15 to 50 weight %, and the Ag powder substantially being the remainder.

* * * * *